US008181581B2

(12) United States Patent
Meiners

(10) Patent No.: US 8,181,581 B2
(45) Date of Patent: May 22, 2012

(54) STACKABLE, INTERLOCKABLE FURNITURE MODULES

(76) Inventor: Mike Meiners, Chicago, IL (US)

( * ) Notice: Subject to any disclaimer, the term of this patent is extended or adjusted under 35 U.S.C. 154(b) by 611 days.

(21) Appl. No.: 11/716,436

(22) Filed: Mar. 9, 2007

(65) Prior Publication Data

US 2007/0227415 A1 Oct. 4, 2007

Related U.S. Application Data

(63) Continuation of application No. 11/714,403, filed on Mar. 6, 2007.

(60) Provisional application No. 60/787,919, filed on Mar. 31, 2006.

(51) Int. Cl.
*A47B 57/00* (2006.01)

(52) U.S. Cl. ..... 108/64; 108/91

(58) Field of Classification Search ..... 108/91, 108/64, 65, 54.1, 56.1, 57.1; 297/232, 243, 297/244, 245
See application file for complete search history.

(56) References Cited

U.S. PATENT DOCUMENTS

| | | | | | |
|---|---|---|---|---|---|
| 2,245,875 | A | * | 6/1941 | Rutherford | 446/487 |
| 3,347,186 | A | * | 10/1967 | Khattar | 108/91 |
| 4,789,122 | A | * | 12/1988 | Gutgsell | 248/188.7 |
| 4,995,668 | A | * | 2/1991 | Zivari | 297/248 |
| 5,511,851 | A | * | 4/1996 | Zivari | 297/249 |
| 5,564,345 | A | * | 10/1996 | Crawford et al. | 108/91 |
| 5,613,448 | A | * | 3/1997 | Petty | 108/91 |

FOREIGN PATENT DOCUMENTS

GB 601889 * 5/1948

* cited by examiner

*Primary Examiner* — Jose V Chen
*Assistant Examiner* — Matthew Ing
(74) *Attorney, Agent, or Firm* — Winston & Strawn LLP

(57) ABSTRACT

Interlocking, stackable articles of furniture are disclosed. The individual components may be used separately, interlocked end to end, stacked in various orientations to create shelving structures, or stacked vertically as a single upstanding unit.

20 Claims, 4 Drawing Sheets

STACKABLE, INTERLOCKABLE FURNITURE MODULES

CROSS-REFERENCE TO RELATED APPLICATIONS

This application claims the benefit under 35 U.S.C. §119 (e) of U.S. Provisional Application Ser. No. 60/787,919, filed Mar. 31, 2006. This application is a continuation of and claims the benefit under 35 U.S.C. §120 of U.S. patent application Ser. No. 11/714,403, filed Mar. 6, 2007, which also claims the benefit under 35 U.S.C. §119(e) of U.S. Provisional Application Ser. No. 60/787,919, filed Mar. 31, 2006.

BACKGROUND OF THE INVENTION

This invention relates generally to stackable, interlocking furniture. More particularly, this invention concerns the appropriate positioning and spacing of the furniture's structural elements to achieve effective interlocking of multiple modules and efficient use of space when multiple modules are stacked for storage or shipment. Among other uses, individual modules of this invention may be used as a general purpose stool, step ladder, ottoman, bench, bedside table, coffee table, or shelving. Multiple modules can be interlocked end to end to form longer single level structures. Multiple modules can be stacked in a variety of configurations to create shelving units or pillars for efficient use of storage space.

U.S. Pat. No. 6,068,331 discloses stackable, nestable articles of furniture including two identical tables and two identical chairs which may be used separately or mated together to form a single cube-like unit. The table units include three legs, one leg extending down from a table surface and having a predetermined width, and the other two legs extending down from the table surface having a space between the legs sized to accommodate the first leg. When assembled into a cube-like unit, the table units are oriented at 180 degrees with respect to each other on the vertical axis and at 180 degrees with respect to each other on the horizontal axis, such that one table surface rests on the ground and the other table surface faces away from the ground. In this orientation, the first leg of one table interlocks with the two legs of the second table and vice versa, created a stacked unit of tables. The associated chairs are similarly designed to nest within the stacked table unit to form the cube-like unit.

While this prior art illustrates an effective way to stack furniture, it suffers from several problems. First, it does not teach any way to stack more than two table units. In situations where more than two tables are in use, this design would force a user to create multiple cube-like units which are not interconnected. Because additional units are not interconnected, vertical storage would result in a safety risk and side by side storage would limit storage room. Second, the table units of the prior art stack inefficiently, again making it difficult to store a large number of units in a small space. Because the patent discloses stacking the legs of one table upon the legs of the other, the composite cube-like unit is nearly as tall as the height of two tables. Therefore, very little vertical space is saved in this storage configuration. Finally, the system does not provide any means for interlocking the table units while the individual components are arranged for use. Thus, long rows of tables are created only by placing the tables next to each other; there is no means of preventing them from coming out of alignment.

The present invention solves all of these problems. It is an object of this invention to allow for the stacking of an indefinite number of furniture modules in an efficient manner.

It is a further object of this invention to create modules capable of interlocking end to end with other modules to create a table or bench-like structure.

Yet another object of this invention is to create a stackable, interlocking shelving units.

Other objects and advantages of the invention will become apparent upon reading the following detailed description and upon reference to the associated drawings.

DESCRIPTION OF DRAWINGS

FIG. 1A is an isometric view of an alternative preferred embodiment for an individual furniture module having a leg arrangement including multiple legs.

DETAILED DESCRIPTION

Figure 1:
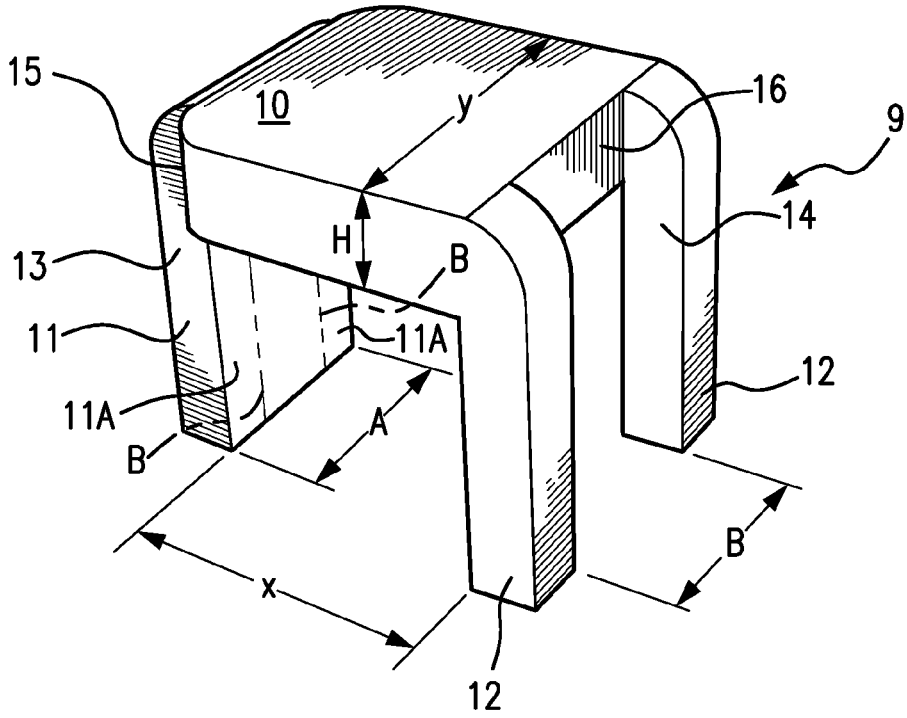
FIG. 1 is an isometric view of the preferred embodiment for an individual furniture module which is made according to this invention.

While the invention will be described in connection with a preferred embodiment, it will be understood that it is not intended to limit the invention to this embodiment. On the contrary, it is intended to cover all alternatives, modifications and equivalents as may be included within the spirit and scope of the invention. The present invention is directed to furniture modules capable of being used individually or being interlocked to form shelving, a bench, or other articles. The modules can also be effectively stacked atop each other.

The furniture modules of this invention may be made of any material, although plastics, metal and woods are preferred because in appropriate types they are light in weight, strong and low in cost. Furthermore, the furniture modules of this invention may be scaled to any size, so long as relevant dimensions described hereafter remain in proportion. Although various modules may, in their final form, appear in different colors and with different design patterns, in the preferred embodiment, all of modules have the same height and shape.

In accordance with the invention, each furniture module 9 is comprised of a preferably square top surface 10, a first set of one or more legs 11, and a second set of at least two legs 12. Both the first set of legs and the second set of legs extend downward from opposing sides of the surface and are preferably offset from the surface edges as illustrated. In the preferred embodiment illustrated in FIG. 1, the surface 10 has a single leg 11 extending downward from one side of the surface 10 and two legs 12 extending downward from the opposite side of the surface 10.

As illustrated in FIG. 1, the first leg 11 has a predetermined width A between its outermost surfaces 13. In another embodiment of the invention also illustrated in FIG. 1, multiple legs 11A designated by dashed lines B could replace the unitary first leg 11. However, in such an embodiment, the predetermined width between the outermost surfaces of the outermost legs must remain A.

Figure 2:
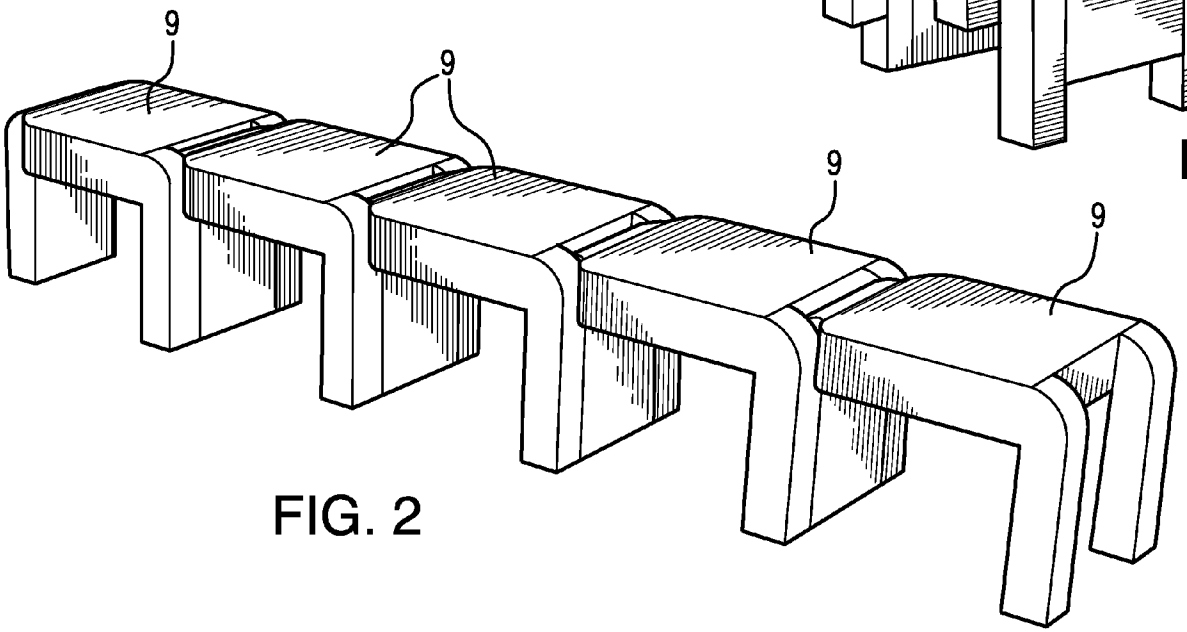
FIG. 2 is an isometric view of several of the furniture modules of FIG. 1 as they appear when they are placed end to end in interlocked relationship to prevent lateral movement.

Referring back to FIG. 1, the two legs 12 are spaced apart from each other, creating a void of width B between the innermost leg surfaces 14. The width B must be greater than or equal to the predetermined width A in order to accommodate insertion of the first leg 11 at an adjacent but (here) identical module 9 into the void created by the separation of the two legs 12, as illustrated in FIG. 2. Although the preferred embodiment discloses the use of two legs to create the void, any number of legs may be used so long as the width between the innermost surfaces of the innermost legs remains width B.

In the preferred embodiment of FIG. 2, the modules interlock. This is accomplished in the preferred embodiment by protruding, the first leg 11 from the surface edge 15 and by protruding, the two legs 12 from the surface edge 16, as illustrated in FIG. 1. The protruding first leg 11 of a first module is inserted into the void created by the protruding two legs 12 of a second module, thus preventing lateral movement. Longitudinal movement can be prevented by providing interlocking dovetail formations (not shown) in the leg surfaces 13 and 14.

Alternatively, the invention includes placement of the legs directly underneath the surface, rather than in an offset position. In this embodiment, the legs of a first module (not shown) would be positioned outside or beyond the perimeter of the surface of a second, nested module. This second module would nest within the void between the innermost surfaces of the legs of the first module. This would also result in interlocking modules that prevent lateral movement.

Figure 3:
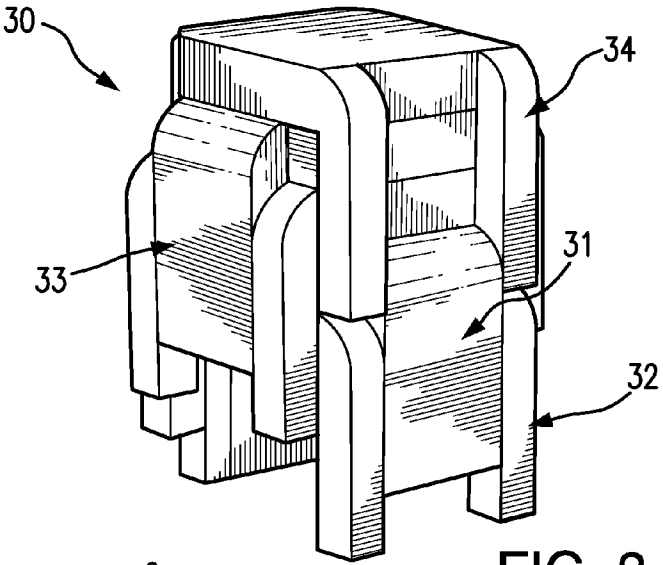
FIG. 3 is an isometric view of several of the furniture modules of FIG. 1 as they appear when they are stacked atop one another and oriented with respect to each other for efficient storage.

In accordance with a further aspect of this invention, FIG. 1 illustrates that the space between the first leg 11 and the two legs 12 has a predetermined length X. The maximum width Y of the surface 10 is less than or equal to the predetermined length X. As shown in FIG. 3, this spacing permits the stacking of a first module 31 upon a second module 32, with the first module 31 oriented at 180 degrees with respect to the second module 32. This arrangement increases the height of the combined structure by only the height H of the surface 10 and thus maximizes storage space. As further illustrated in FIG. 3, by orienting a third module 33 at ninety degrees in either direction with respect to the second module 32, the third module 33 may be stacked upon the second module 32. In addition, by stacking a fourth module oriented at 180 degrees in either direction with respect to the third module 33, a stacking unit 30 is created. The entire configuration can be locked in place by placing a fifth module atop the stack, as illustrated in FIG. 3. Repetition of this process permits the stacking of an indefinite number of furniture modules.

Figures 4, 5:
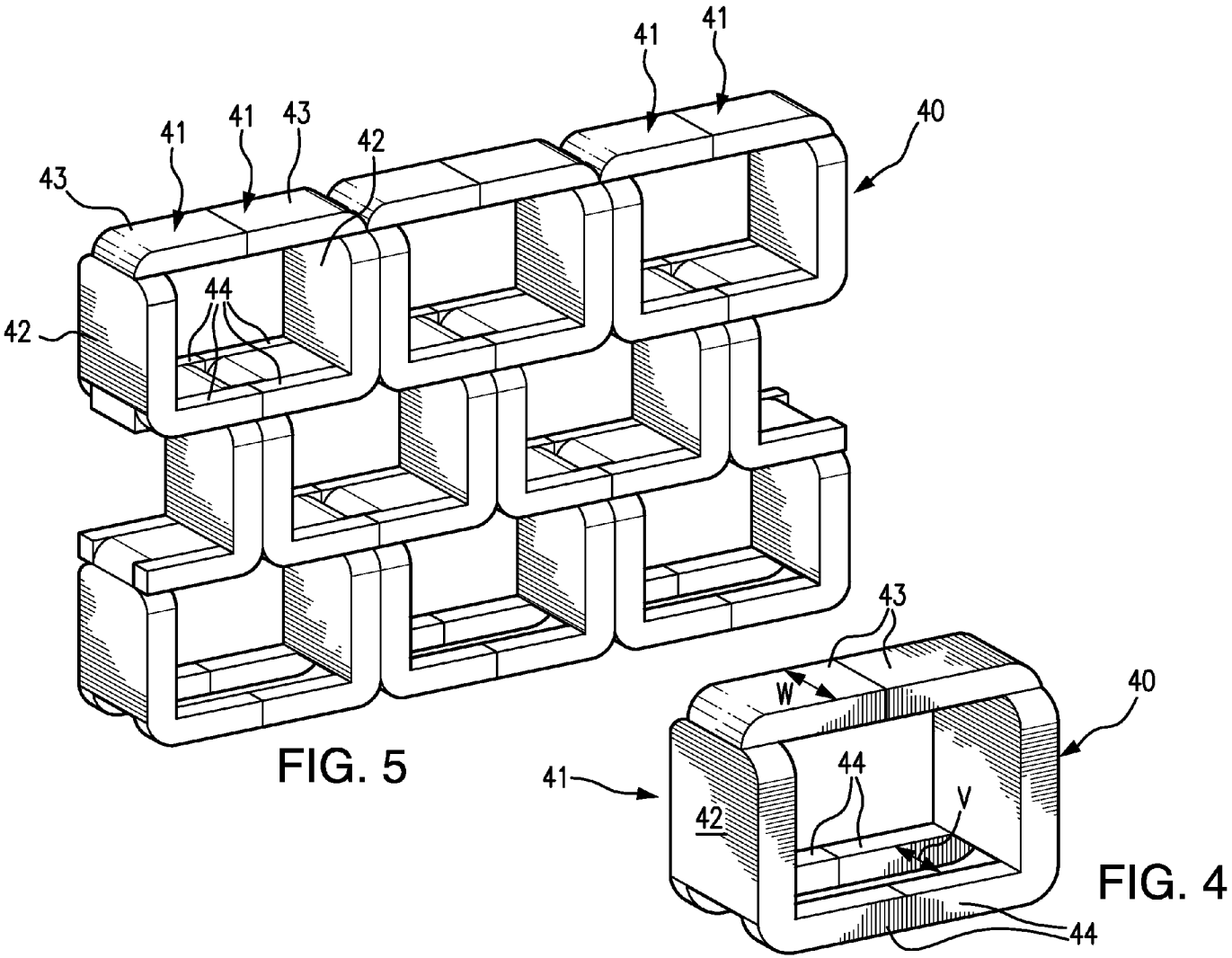
FIG. 4 is an isometric view of the preferred embodiment arranged to provide a shelving unit according to this invention.
FIG. 5 is an isometric view of a first configuration for the shelving units of FIG. 4 stacked atop and interlocked with each other.

FIG. 4 illustrates an embodiment of yet another aspect of this invention. FIG. 4 depicts an embodiment of a shelving unit 40 created through the combination of two identical shelf modules 41. These modules 41 are identical in configuration with the modules in FIGS. 1-3. Each shelf module 41 includes a side surface 42, a top leg 43, and two bottom legs 44. The top leg 43 and the bottom legs 44 extend perpendicularly to the side surface 42 in the same direction. The top leg 43 is designed with a predetermined width W. The bottom legs 44 are spaced apart so that the width between the innermost surfaces of the two legs is V, a distance greater than or equal to the predetermined width W.

As seen in FIG. 5, the spacing is such that the top leg 53 of one shelf module 51 will nest within the space between the bottom legs 54 of a second shelf module 52, effectively interlocking shelf module 51 and shelf module 52.

The shelf modules of FIG. 4 are configured and oriented so that the top legs 43 and the bottom legs 44 of two shelf modules 41 confront each other. The combination of the two shelf modules in this orientation constitutes a shelving unit. Although the shelving unit depicted in FIG. 4 is the preferred embodiment, multiple variations can be created. As an example, any number of legs may be used as a substitute for the top leg or the bottom legs, so long as the space between the innermost surfaces of the innermost bottom legs remains greater than or equal to the width of the outermost opposing surfaces of the outermost top legs. Aside from this spacing limitation, the shelving units 41 may come in any size or shape. However, each shelf module 41 must be substantially identical in size and shape when compared to the other modules.

Figure 6:
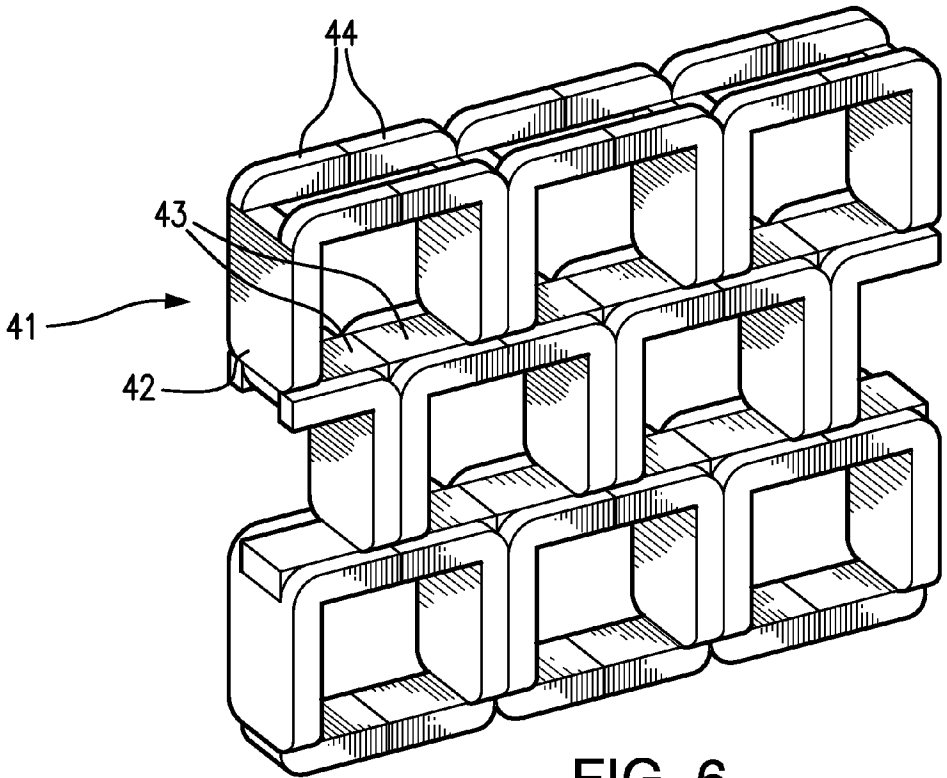
FIG. 6 is an isometric view of a second configuration for the shelving units of FIG. 4 stacked atop and interlocked with each other.

The shelving units of FIG. 4 can be combined into a variety of structures, some of which are illustrated in FIGS. 5 and 6. To accomplish this, all shelving units and shelf modules used to create the shelving structure are oriented in the same direction. The shelving units should be oriented so that at least one flat surface of the shelving unit is parallel to the ground. As illustrated in FIG. 5, each shelving unit 41 is oriented such that the top legs 43 face down and the bottom legs 44 face up. A number of shelving units are placed side by side so that the side surface 42 of one shelving unit 43 abuts the side surface 42 of another shelving unit 41. Another second-level shelving unit 41 may be placed atop the ground level shelving units 41 just described. The second-level shelving unit 41 is centered above the point where the side surfaces 42 of the ground level shelving units 41 meet. The top legs 43 of the second-level shelving unit 42 nest within the space created by the bottom legs 44 of the ground level shelving units 41, interlock all of the shelving units and preventing lateral movement. Due to this spacing, it is necessary to fill out the second level with a single shelf module 41 at each end. As before, the side surface 42 of the shelf module 41 abuts the side surface 42 of the adjacent shelving unit 41 and the top leg 43 of the shelf module 41 interlocks with the bottom legs 44 of the ground level shelving unit. By repeating this process, a shelving structure of indefinite length and height can be achieved.

The same approach may be used by rotating the shelving units and shelf modules in any direction, so long as one surface remains parallel to the ground. In the further embodiment of FIG. 6, the same approach is used, however the shelving units 11 are oriented such that the top legs 44 face up and the bottom legs 43 face down.

Although the preferred embodiments illustrated in the drawings show square surfaces, invention comprehends any shaped surface that permits attachment of the required leg structures. Furthermore, except where otherwise required, the legs need not be perpendicular to the surface, but may extend from the surface at any angle so long as the required proportional dimensions are not violated.

While the invention has been described in a preferred form, it will be understood that changes, additions, and modifications may be made to the respective articles forming the invention. Accordingly, no limitation should be imposed on the scope of this invention, except as set forth in the accompanying claims.

I claim:

1. Furniture comprising a plurality of modules which interlock to form the furniture, each module being substantially identical in size and shape and comprising:

a support surface having a thickness and predetermined width;

at least three legs attached to the surface and extending therefrom in the same direction, with:

a first leg arrangement placed adjacent a first edge of the surface and having a thickness, outside edges and a predetermined width terminating at the outside edges; and a second leg arrangement of at least two second legs placed adjacent a second edge of the surface that is opposite to the first surface edge, with the two legs each having a thickness and an inside edge, with the two second legs spaced apart by a distance that is substantially equal to the predetermined width of the first leg arrangement, wherein the outside edges of the first leg arrangement are configured for parallel alignment with the inside edges of the second legs to facilitate interlocking of the at least two second legs of one module around the first leg arrangement of another module to form a load bearing structure;

wherein the first leg arrangement is spaced apart from the at least two second legs by a predetermined distance that is substantially the same as or greater than the width of the supporting surface to facilitate compact stacking of the modules for storage thereof; and wherein the leg arrangements are configured in such a way as to make it equally possible, no matter which surface a first module rests upon, to interlock the two legs of the second leg arrangement of one module with the first leg arrangement of a second module in any of the following ways beginning with the first and second modules each resting on the same surface and with:

(a) the second module situated adjacent to the first module in the direction of the first module's second leg arrangement with the first leg arrangement of the first module disposed adjacent the inside edges of the two second legs to form a bench, (b) the second module rotated 180 ° about an axis extending perpendicular to the surface of its first leg arrangement and situated adjacent to the first module in the direction of the first module's second leg arrangement to form a component of a shelving unit, or (c) the second module rotated 180 ° about an axis extending perpendicular to the primary support surface and situated adjacent to the first module in the direction of the first module's primary support element to form a stacking unit.

2. Furniture according to claim 1 wherein in each module the first leg arrangement is spaced apart from the at least two second legs by a predetermined distance that is substantially the same as the width of the supporting surface to facilitate compact stacking of the modules for storage thereof.

3. Furniture according to claim 1, wherein for each module, the thickness of the first leg arrangement is substantially the same as the thickness of the at least two second legs to assist in interlocking the modules together.

4. Furniture according to claim 3, wherein the outside edges of the first leg arrangement is nested within the inside edges of the second legs of another different module to form a row of interlocked modules.

5. Furniture according to claim 4, wherein at least five furniture modules are interlocked in a row to form a bench.

6. Furniture according to claim 1, wherein the modules are composed of wood, plastic or metal and are of preformed, unitary construction.

7. Furniture according to claim 1, wherein in each module the support surface is substantially square and the legs extend from edges of the support surface.

8. Furniture according to claim 7, wherein the legs include a smooth transition between the support surface and the sides of the legs.

9. Furniture according to claim 1, wherein in each module the legs are arranged to be perpendicular to the support surface.

10. Furniture according to claim 1, wherein in each module the first leg arrangement includes multiple legs with the width extending to the outside edges of the outermost legs.

11. Furniture according to claim 1, wherein in each module a plurality of second legs are included, with the spacing of the inside edges of the innermost legs being substantially the same as the width of the first leg arrangement.

12. Furniture comprising a plurality of modules which interlock to form the furniture, each module being substantially identical in size and shape and comprising:

a support surface having a thickness and predetermined width;

at least three legs attached to the surface and extending therefrom in the same direction, with:

a first leg arrangement placed adjacent a first edge of the surface and having a thickness, outside edges and a predetermined width terminating at the outside edges; and an arrangement of at least two second legs placed adjacent a second edge of the surface that is opposite to the first surface edge, with the two legs each having a thickness and an inside edge, with the two second legs spaced apart by a distance that is substantially equal to the predetermined width of the first leg arrangement, wherein the outside edges of the first leg arrangement are configured for parallel alignment with the inside edges of the second legs to facilitate interlocking of the at least two second legs of one module around the first leg arrangement of another module to form a load bearing structure;

wherein the first leg arrangement is spaced apart from the at least two second legs by a predetermined distance that is substantially the same as or greater than the width of the supporting surface to facilitate compact stacking of the modules for storage thereof; and wherein at least two modules form a shelving unit, wherein the support surface of a first module is rotated 90 ° , such that the support surface is vertical in relation to the ground to form a side surface and the first leg arrangement is parallel to the ground; and the support surface of a second module is rotated 90 ° , such that the support surface is vertical in relation to the ground to form a side surface and the at least two second legs are parallel to the ground, such that the first leg arrangement of the first module confronts the at least two legs of the second module; and the outside edges of the first leg arrangement are configured for alignment with the inside edges of the second legs to facilitate interlocking of the at least two second legs of one module around the first leg arrangement of another module to form a load bearing structure, and the first leg arrangement is configured and dimensioned to function as a support surface when oriented parallel to the ground.

13. Furniture comprising a plurality of modules which interlock to form the furniture, each module being substantially identical in size and shape and comprising:

a support surface having a thickness and predetermined width;

at least three legs attached to the surface and extending therefrom in the same direction, with:

a first leg arrangement placed adjacent a first edge of the surface and having a thickness, outside edges and a predetermined width terminating at the outside edges; and an arrangement of at least two second legs placed adjacent a second edge of the surface that is opposite to the first surface edge, with the two legs each having a thickness and an inside edge, with the two second legs spaced apart by a distance that is substantially equal to the predetermined width of the first leg arrangement, wherein the outside edges of the first leg arrangement are configured for parallel alignment with the inside edges of the second legs to facilitate interlocking of the at least two second legs of one module around the first leg arrangement of another module to form a load bearing structure; and wherein the first leg arrangement is spaced apart from the at least two second legs by a predetermined distance that is substantially the same as or greater than the width of the supporting surface to facilitate compact stacking of the modules for storage thereof;

wherein at least two modules that form a shelving unit are rotated 90° so that the support surfaces are vertical in relation to the ground to form side surfaces with the bottom of the first leg arrangement of a first module abutting the bottom of the first leg arrangement of a second module, and the bottoms of the second legs of the first module butt against the bottoms of the second legs of the second module, to form a shelving unit.

14. The furniture according to claim 13, wherein the second legs rest on a surface and the first leg arrangements cooperate to function as a support surface above the second legs.

15. Furniture according to claim 14, which includes:

a first level of a plurality of shelving units placed side by side, so that the vertical support surface of one shelving unit abuts the vertical support surface of another shelving unit; and at least a second level of a plurality of modules positioned on top of the first level units, such that the first leg arrangement of the first level shelving units nest within the space created by the second legs of the modules of the second level to interlock all modules together to resist lateral movement.

16. Furniture according to claim 15, wherein at least a third level of modules are positioned on top of the second level of modules, such that the first leg arrangement of the second level modules nest within the space created by the second legs of the third-level shelving units to interlock all modules together to resist lateral movement.

17. The furniture according to claim 13, wherein the first leg arrangements rest on a surface to cooperate to function as a support surface and the second legs are above the first leg arrangements.

18. Furniture according to claim 17, which further comprises:

a first level of a plurality of shelving units placed side by side, so that the vertical support surface of one shelving unit abuts the vertical support surface of another shelving unit;

a second level of modules positioned on top of the shelving units of the first level, such that the first leg arrangement of the second level modules nest within the space created by the second legs of the first level shelving units to interlock all modules together to resist lateral movement; and a third level of a plurality of shelving units placed side by side positioned on top of the second level of modules, such that the first leg arrangement of the shelving units of the third level nest within the space created by the second legs of the second level modules to interlock all modules together to resist lateral movement.

19. Furniture comprising a plurality of modules which interlock to form the furniture, each module being substantially identical in size and shape and comprising:

a support surface having a thickness and predetermined width;

at least three legs attached to the surface and extending therefrom in the same direction, with:

a first leg arrangement placed adjacent a first edge of the surface and having a thickness, outside edges and a predetermined width terminating at the outside edges; and an arrangement of at least two second legs placed adjacent a second edge of the surface that is opposite to the first surface edge, with the two legs each having a thickness and an inside edge, with the two second legs spaced apart by a distance that is substantially equal to the predetermined width of the first leg arrangement, wherein the outside edges of the first leg arrangement are configured for parallel alignment with the inside edges of the second legs to facilitate interlocking of the at least two second legs of one module around the first leg arrangement of another module to form a load bearing structure;

wherein the first leg arrangement is spaced apart from the at least two second legs by a predetermined distance that is substantially the same as or greater than the width of the supporting surface to facilitate compact stacking of the modules for storage thereof; and wherein the furniture form a stacking unit that includes:

a first module;

a second module rotated 180 degrees with respect to the first module and stacked atop the first module;

a third module rotated 90 degrees with respect to the second module and stacked atop the second module; and a fourth module rotated 180 degrees with respect to the third module and stacked atop the third module.

20. Furniture according to claim 19 wherein in each module the first leg arrangement is spaced apart from the at least two second legs by a predetermined distance that is substantially the same as the width of the supporting surface to facilitate compact stacking of the modules for storage thereof.

* * * * *